US007131546B1

(12) United States Patent
Price et al.

(10) Patent No.: US 7,131,546 B1
(45) Date of Patent: Nov. 7, 2006

(54) PRODUCT DISPLAY SUPPORT SYSTEMS AND METHODS

(75) Inventors: Jerry Price, Mount Vernon, WA (US); Paul S. Wells, Mount Vernon, WA (US)

(73) Assignee: Mobile Merchandisers, Inc., Mount Vernon, WA (US)

( * ) Notice: Subject to any disclaimer, the term of this patent is extended or adjusted under 35 U.S.C. 154(b) by 353 days.

(21) Appl. No.: 10/766,075

(22) Filed: Jan. 28, 2004

(51) Int. Cl.
*A47F 5/00* (2006.01)
*A47H 1/00* (2006.01)

(52) U.S. Cl. ..... 211/86.01; 211/103; 211/106; 211/118; 211/DIG. 1

(58) Field of Classification Search ..... 211/87.01, 211/86.01, DIG. 1, 103, 113, 118, 119.004, 211/117, 106, 189, 175, 119.003; 248/683, 248/206.5, 309.4; 220/483; 24/303; 206/818, 206/350
See application file for complete search history.

(56) References Cited

U.S. PATENT DOCUMENTS

| | | | | |
|---|---|---|---|---|
| 2,156,184 | A | 4/1939 | Koski | |
| 2,977,082 | A | 3/1961 | Harris | |
| 3,017,036 | A | 1/1962 | Albert et al. | |
| 4,586,616 | A | 5/1986 | Cooper et al. | |
| 4,609,173 | A | 9/1986 | Belokin | |
| 5,037,051 | A * | 8/1991 | Moriello | 248/215 |
| 5,078,281 | A | 1/1992 | Johnson | |
| 5,333,744 | A * | 8/1994 | LoCicero et al. | 211/87.01 |
| 5,460,305 | A | 10/1995 | Ahearn | |
| 5,477,967 | A * | 12/1995 | Voorhees et al. | 211/55 |
| 5,484,932 | A * | 1/1996 | Marhold | 568/656 |
| 5,526,941 | A * | 6/1996 | Ford | 211/59.1 |
| 5,639,060 | A * | 6/1997 | Spoonts et al. | 248/683 |
| 5,695,073 | A * | 12/1997 | Klein et al. | 211/35 |
| 5,788,093 | A * | 8/1998 | Krut | 211/119 |
| 5,894,940 | A * | 4/1999 | Gusdorf et al. | 211/35 |
| 5,931,316 | A * | 8/1999 | Carpinelli | 211/50 |
| 5,941,623 | A | 8/1999 | Linehan | |
| 5,979,675 | A * | 11/1999 | Moriarty | 211/60.1 |
| 6,152,311 | A * | 11/2000 | German | 211/86.01 |
| 6,216,888 | B1 * | 4/2001 | Chien | 211/87.01 |
| 6,318,569 | B1 | 11/2001 | Rothing | |
| 6,352,229 | B1 | 3/2002 | Adams | |
| 6,540,093 | B1 * | 4/2003 | Shumway | 211/90.02 |
| 6,588,606 | B1 | 7/2003 | Miller, Jr. et al. | |
| 6,712,229 | B1 * | 3/2004 | Fritsche et al. | 211/189 |
| 6,951,290 | B1 * | 10/2005 | Speed | 211/113 |
| 2003/0038100 | A1 | 2/2003 | Liu | |
| 2004/0007549 | A1 * | 1/2004 | Klein et al. | 211/118 |
| 2004/0094494 | A1 * | 5/2004 | Klein et al. | 211/119.004 |
| 2004/0118791 | A1 * | 6/2004 | Rimback et al. | 211/34 |

* cited by examiner

*Primary Examiner*—Jennifer E. Novosad
(74) *Attorney, Agent, or Firm*—Michael R. Schacht; Schacht Law Officce, Inc.

(57) ABSTRACT

A support system for supporting a product for retail display comprises an accessory, a rear portion, a front portion, and a magnetic portion. The accessory is adapted to support the product for retail display. The front portion supports the accessory and is rigidly connected to the rear portion. The magnetic portion is adapted rigidly connected to the rear portion. When the rear portion extends at least partly along a top surface of a metal structure, the front portion extends at least partly along a display surface thereof. The rear portion is supported by the top surface of the metal structure to transfer to the metal structure downward loads on the front portion. The magnetic portion is magnetically attracted to the top surface of the metal structure to inhibit movement of the front portion away from the display surface.

18 Claims, 5 Drawing Sheets

PRODUCT DISPLAY SUPPORT SYSTEMS AND METHODS

TECHNICAL FIELD

The present invention relates to systems and methods for displaying products in a retail setting and, more specifically, to display support systems and methods that support products on metal product display cases.

BACKGROUND OF THE INVENTION

The present invention generally relates to display rack systems for use in retail sales environments. The following discussion describes the present invention in the context of such display shelf on which product is arranged for display. The principles of the present invention may, however, be more broadly applied to other support structures for types of product that are not typically displayed on shelves. The scope of the present invention should thus be determined by the claims appended hereto and not the following detailed discussion.

Product display support systems, also sometimes referred to as point-of-purchase displays, are manufacture and sold in a large number of configurations. Some point-of-purchase displays are free-standing units, while others are adapted to be placed on or supported by a structural member such as a countertop. In a retail environment, product space is at a premium, and at many retail stores point-of-purchase displays are placed at all feasible locations.

Retail stores often employ metal display cases for the display of product. For example, refrigerated display cases are often used to display frozen products and products requiring refrigeration. Refrigerated display cases typically comprise a metal housing and a glass door. The metal housing defines a front or door surface, a rear surface, left and right side surfaces, a top surface, and a bottom surface. The door surface defines a door opening through which product is accessed, and the glass door conventionally covers the door opening. Typically, the product is visible through the glass door.

Metal display cases may be arranged side by side in a row facing an aisle or may be placed at the end of a row. In these situations, the at least one of the metal left and right side surfaces may be exposed to consumers. Because space is at such a premium in the retail environment, retailers would like to make use of the exposed side surfaces of a metal display case. In the following discussion, either one of the side surfaces of a metal display case that is exposed to consumers will be referred to as a display surface.

To make use of a display surface, a standalone display rack may be placed on the floor adjacent to the display surface. However, a standalone display rack may occupy too much floor space for a given environment and/or may not cover the entire display surface. Shelf components may be screwed directly to the display surface or another part of the display case. However, many display cases are insulated and/or contain electrical components, and piercing the surface of the case with a screw is undesirable.

The need thus exists for product display support systems and methods that allow display surfaces on metal display cases to be utilized in a manner that is cost effective and flexible.

RELATED ART

The following U.S. patents were uncovered as part of a professional patentability search conducted on behalf of the Applicant.

U.S. Pat. No. 5,941,623 to Linehan discloses a storage system for refrigerators in which two sheets are arranged on each side of the refrigerator. A strap extends over the top of the refrigerator between the two side sheets. The side panels support each other through the strap like saddle bags. The device disclosed in the Lineham patent relies on friction and the weight of the opposite side sheets to support the device in a desired position on the refrigerator.

U.S. Pat. No. 6,318,569 to Rothing discloses a magnetic shelf that is attached to the side of a refrigerator. The magnets simply engage the vertical side of the refrigerator and thus would not carry significant weight.

U.S. Pat. No. 6,588,606 to Miller, Jr. et al. discloses the use of suction-type attachment assemblies to support a display rack from a vertical surface.

The remaining patents simply relate to magnetic attachment systems and are not specifically designed for displaying or suspending items from a metal display case.

U.S. Patent Application No. US 2003/0031800 discloses a magnet equipped rack for tools and the like.

U.S. Pat. No. 6,352,229 to Adams discloses a clip assembly having a magnetic base and a flexible clip.

U.S. Pat. No. 5,460,305 to Ahearn discloses a tool pouch employing magnets to attach the tool pouch to a metal structure such as a vehicle.

U.S. Pat. No. 5,078,281 to Johnson discloses a swivel bracket for a mechanic's work tray. This swivel bracket has a magnetic attachment for securing the bracket to a metal surface.

U.S. Pat. No. 4,609,173 to Belokin discloses a magnetically attachable towel hanger. The magnets are arranged to engage a vertical surface.

U.S. Pat. No. 4,586,616 Cooper et al. discloses a utensil mounting bar having a magnet backing. The utensil bar may be adapted to support a towel rack, tool rack, or the like from vertical metal surface.

U.S. Pat. No. 3,017,036 to Albert et al. discloses a magnetic support for allowing towel racks, hooks, and the like to be attached to a vertical metal surface.

U.S. Pat. No. 2,977,082 to Harris discloses a magnetic support having a bolt assembly formed therein. The bolt assembly allows the metal support to be used with a variety of different items. FIG. 6 is of interest in that it engages a horizontal surface. In this embodiment, the support is attached to a paper holder for holding a sheet of paper.

SUMMARY OF THE INVENTION

The present invention may be embodied as a support system for supporting a product for retail display comprising an accessory, a rear portion, a front portion, and a magnetic portion. The accessory is adapted to support the product for retail display. The front portion supports the accessory and is rigidly connected to the rear portion. The magnetic portion is adapted rigidly connected to the rear portion. When the rear portion extends at least partly along a top surface of a metal structure, the front portion extends at least partly along a display surface thereof. The rear portion is supported by the top surface of the metal structure to transfer to the metal structure downward loads on the front portion. The magnetic portion is magnetically attracted to the top surface of the metal structure to inhibit movement of the front portion away from the display surface.

DETAILED DESCRIPTION OF THE INVENTION

Figure 1:
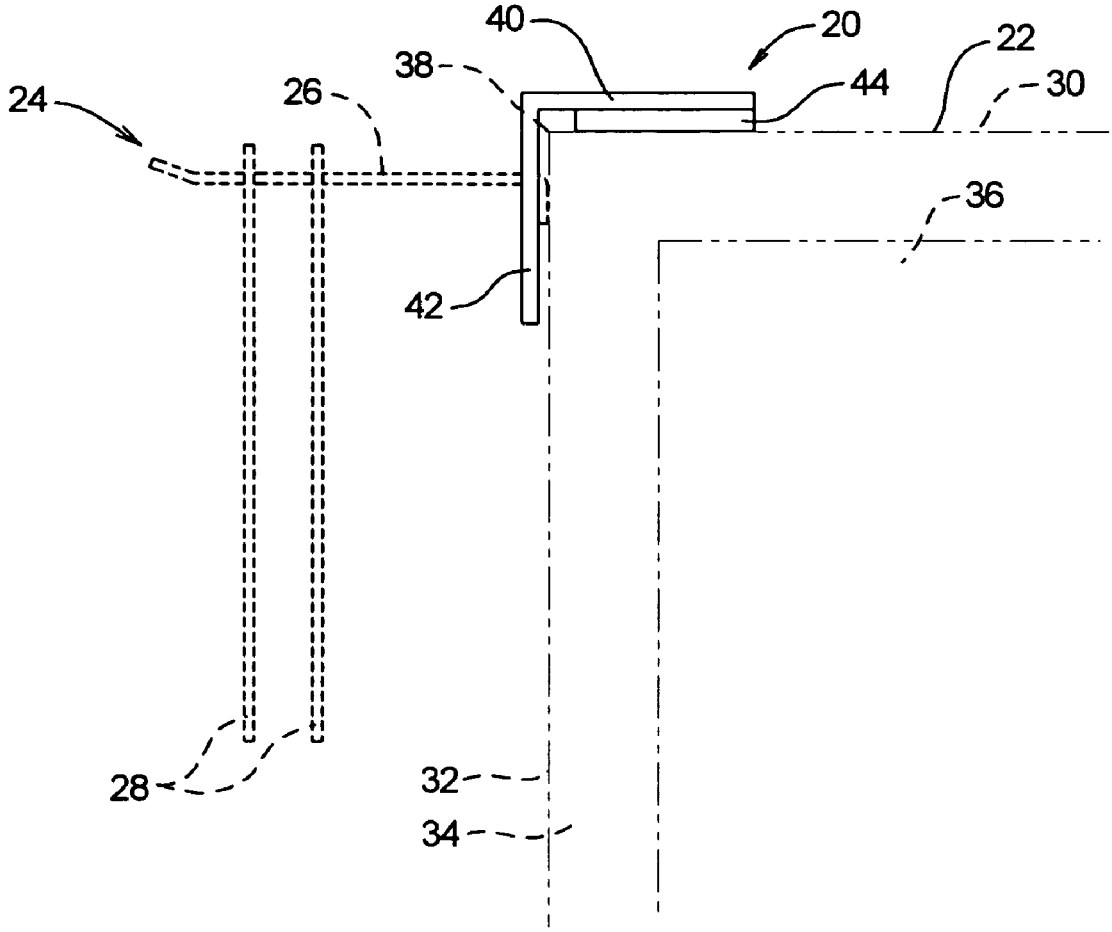
FIG. 1 is a side elevation view of a first embodiment of a display support system embodying, and constructed in accordance with, the principles of the present invention.

Referring now to the drawing, depicted at 20 in FIG. 1 thereof is a display support system constructed in accordance with, and embodying, the principles of the present invention. The display support system 20 is adapted to be supported by a metal structure 22.

The example display support system 20 is depicted supporting an accessory 24 in the form of a wire support 26. The wire support 26 is shown supporting a plurality of products 28. The wire support 26 is not per se part of the present invention, may be conventional, and will be described herein only to the extent necessary for a complete understanding of the present invention. The products 28 are illustrated as examples only, and other products with different packaging may be supported by the system 20.

The metal structure 22 is also not per se part of the present invention and will be described briefly herein to provide a complete understanding of the present invention. The metal structure 22 defines a top surface 30 and a display surface 32. The example metal structure 22 thus further defines a door surface 34 and comprises a glass door 36 through which product may be viewed and accessed. The metal structure 22 is generally in the form of a box, and the top, display, and door surfaces 30, 32, and 34 form three adjacent sides of the box. An upper edge 38 is formed at the juncture of the top surface 30 and display surface 32.

The display support system 20 comprises a rear portion 40, a front portion 42, and a magnetic portion 44. The rear portion 40 is adapted to rest on the top surface 30 of the metal structure 22 adjacent to the upper edge 38. The rear portion 40 is rigidly connected to the magnetic portion 44. The magnetic portion 44 magnetically engages the top surface 30 of the metal structure 22 as shown in FIG. 1. In addition, the front portion 42 is rigidly connected to the rear portion 40 such that, when the magnetic portion 44 engages the top surface 30, the front portion 42 extends along at least a portion of the display surface 32.

Figure 2:
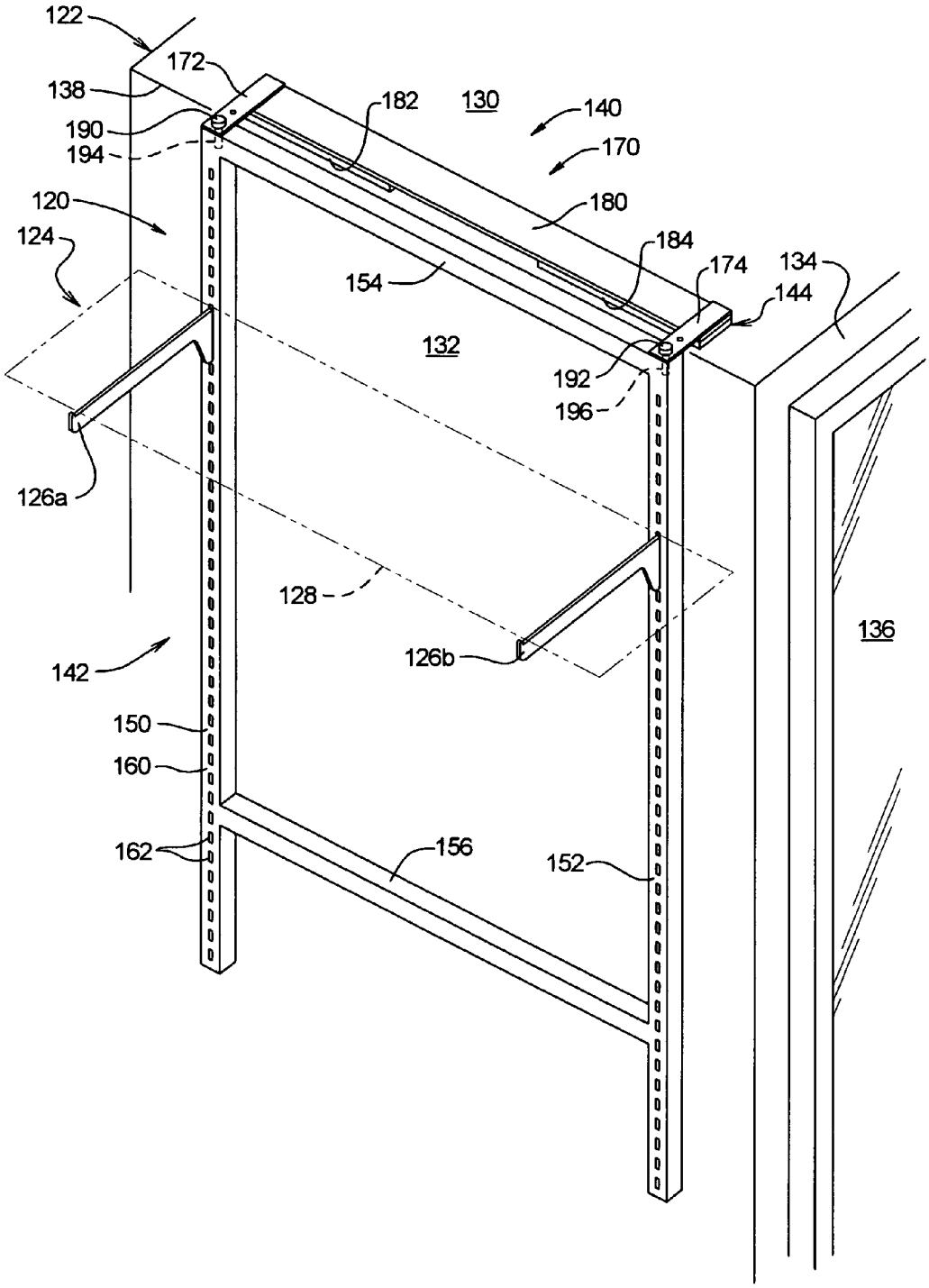
FIG. 2 is a perspective view of a second embodiment of a display support system embodying, and constructed in accordance with, the principles of the present invention.

In use, at least part of the front portion 42 is arranged below the rear portion 40; typically, most of the front portion 42 is arranged below the rear portion 40 as shown in FIGS. 1 and 2. The center of gravity of the support system 20, including any accessories 24 and products 28 supported thereby, is thus typically arranged below the top surface 30 along the display surface 32.

Under static conditions, the weight of the accessory 24 and any products 28 supported thereby places a downward load on the front portion 42 of the display support system 20. Because the front portion 42 is rigidly connected to the rear portion 40, the rear portion 40 in turn transfers to the top surface 30 these downward loads on the front portion 42.

Outward lateral loads on the front portion 42 away from the display surface 32 may be created through various mechanisms. For example, lateral loads on the front portion 42 may be created by accidental jostling of the front portion 42 or any accessories 24, hangers 26, or products 28. Such outward lateral loads tend to be momentary and relatively light in comparison to the downward loads.

Friction between the top surface 30 and the rear portion 40 of the display support system 20 will, to some degree, resist displacement of the system 20 due to outward lateral loads on the front portion 42 thereof. However, the magnetic engagement between the magnetic member 44 and the top surface 30 of the metal structure 22 significantly enhances the resistance to displacement of the system 20 caused by outward lateral loads on the front portion 42.

The magnetic engagement between the magnetic portion 44 of the display support system 20 and the top surface 30 of the metal structure 22 thus resists or prevents inadvertent displacement of the display support system 20 relative to the metal structure 22 under typical outward lateral loads on the front portion 42 of the display support system 20. However, the display support system 20 does not require modification of the metal structure 22 by, for example, the formation of screw holes in the top surface 30 or display surface 32.

To remove the display support system 20, the user simply applies deliberate manual force on the front portion 42 of the system 20 to disengage the magnetic portion 44 from the top surface 32. The entire display support system 20 can then easily be removed from or moved on the metal structure 22.

With the foregoing general understanding of the construction and use of the invention as embodied in the example display support system 20, a second embodiment of the present invention will now be described.

Referring now to FIGS. 2–7, depicted therein is a second embodiment of a display support system 120 of the present invention. In the following discussion, elements of the display support system 120 that are similar to those of the display support system 20 described above will be identified by the same or similar reference characters increased by 100.

The example display support system 120 is depicted supporting accessories 124 in the form of first and second brackets 126*a* and 126*b*. The first and second brackets 126 are in turn shown supporting a shelf 128. An item to be displayed may be placed on the shelf 128. The brackets 126 and shelf 128 are or may be conventional and will be described herein only to the extent necessary for a complete understanding of the present invention.

The example metal structure 122 defines a top surface 130 and a display surface 132. The example metal structure 122 is a refrigerated display case and thus further defines a door surface 134 and comprises a glass door 136 through which product may be viewed and accessed. The metal structure 122 is generally in the form of a box, and the top, display, and door surfaces 130, 132, and 134 form three adjacent sides of the box. An upper edge 138 is formed at the juncture of the top surface 130 and display surface 132.

The example display support system 120 comprises a rear portion 140, a front portion 142, and a magnetic portion 144. The rear portion 140 is adapted to rest on the top surface 130 of the metal structure 122 adjacent to the upper edge 138. The rear portion 140 further magnetically engages the tops surface 130 as will be described in further detail below. The front portion 142 is rigidly connected to the rear portion 140 such that, when the rear portion 140 engages the top surface 130, the front portion 142 extends along at least a portion of the display surface 132.

A display support system constructed in accordance with the principles of the present invention can be made of a variety of materials and take on a number of configurations. In the example display support system 120, the front portion 142 comprises first and second vertical members 150 and 152 and upper and lower lateral members 154 and 156 formed of hollow metal tubes welded together in a generally rectangular configuration. Hollow metal tubes are readily available, lightweight, and durable, but the front portion 142 may be made from other materials such as plastic, wood, or the like.

Figure 3:
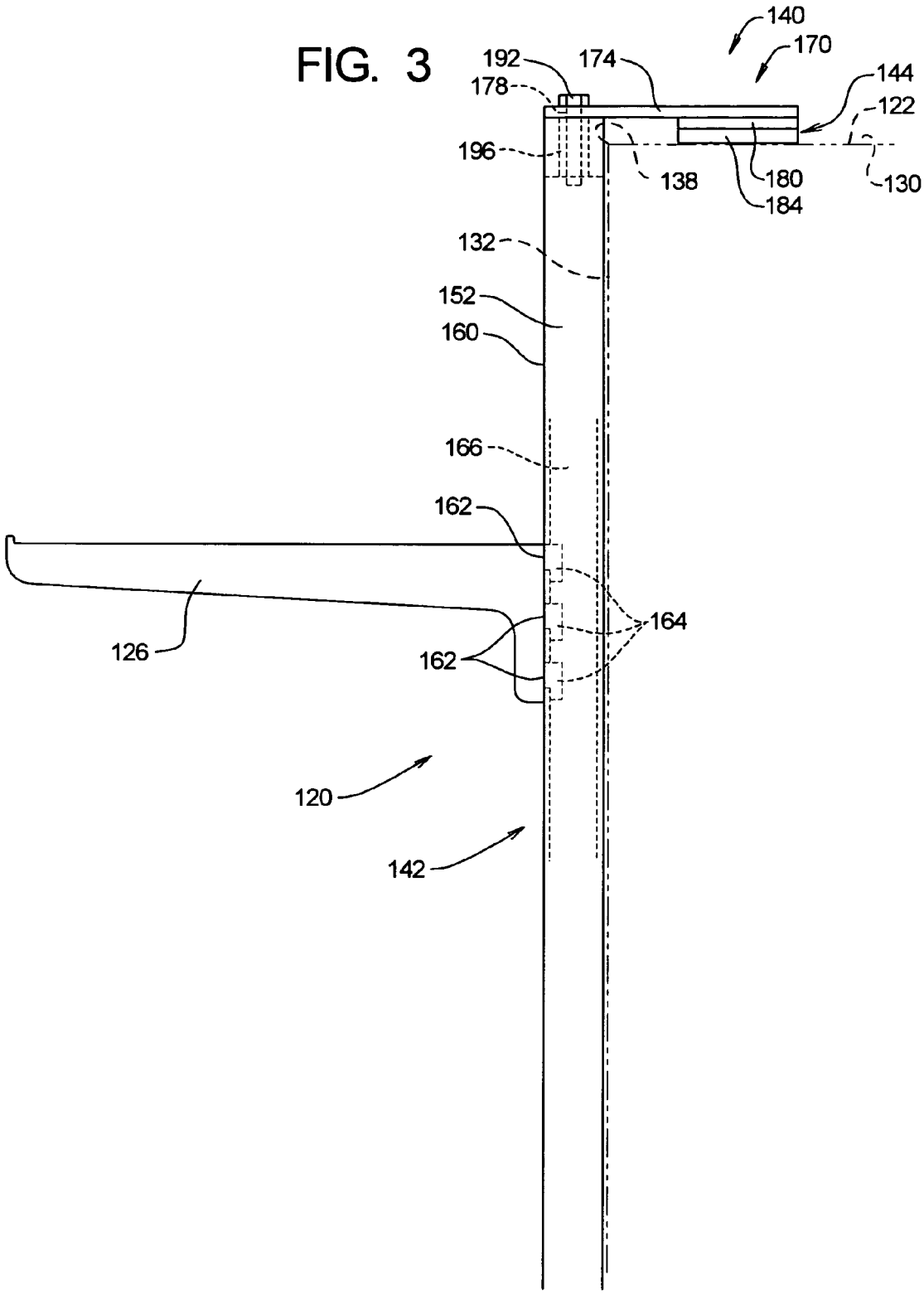
FIG. 3 is a side elevation view of the example display support system depicted in FIG. 2.
Figure 4:
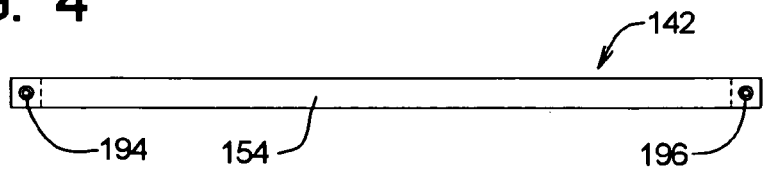
FIG. 4 is a top plan view of a front portion of the display support system depicted in FIG. 2.
Figure 5:
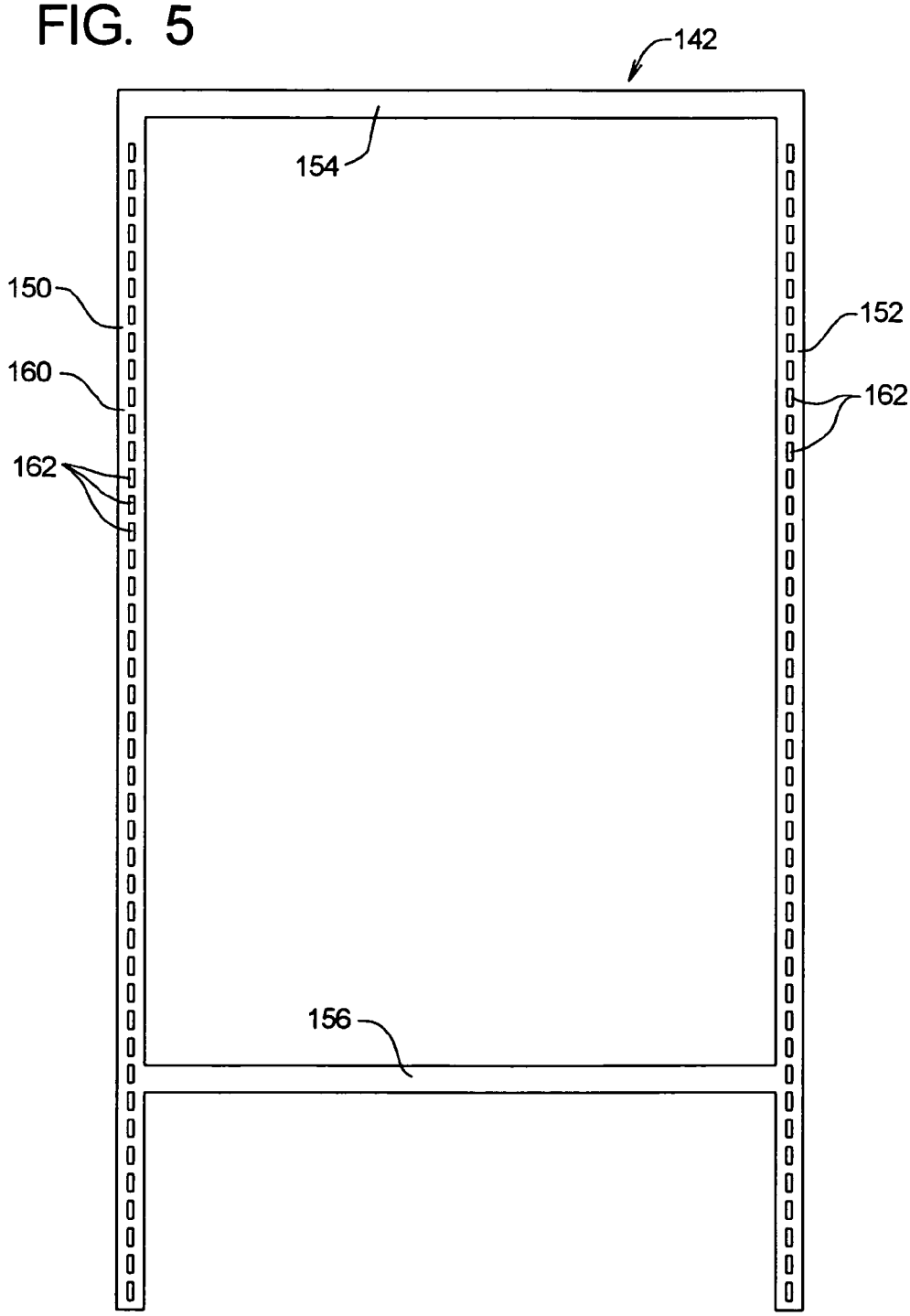
FIG. 5 is a front elevation view of the front portion of the display support system depicted in FIG. 4.
Figure 6:
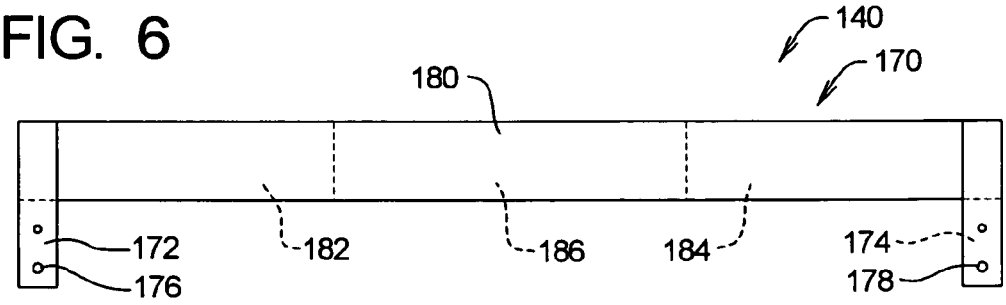
FIG. 6 is a top plan view of a rear portion of the display support system depicted in FIG. 4.
Figure 7:
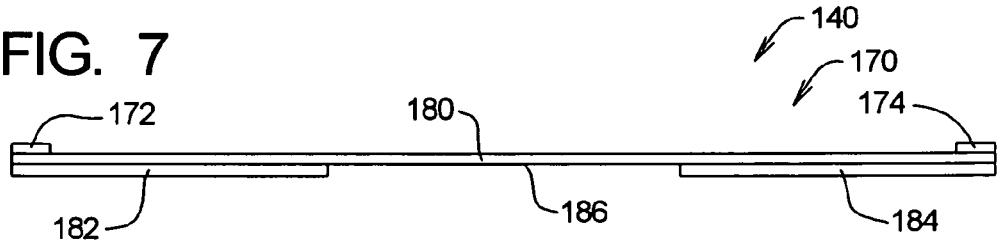
FIG. 7 is a front elevation view of the rear portion of the display support system as depicted in FIG. 6.

As shown in FIG. 3, the hollow metal tubes that form the vertical members 150 and 152 define a front wall 160 in which a series of slots or openings 162 are formed. As is conventional, the openings 162 allow tabs 164 extending from the brackets 126 to extend into interior chambers 166 defined by the vertical members 150 and 152. The tabs 164 engage the front wall 160 to secure the brackets 126 at desired vertical locations along the vertical members 150 and 152. The example brackets 126 are arranged at substantially the same vertical level such that the shelf 128 is substantially level during normal use.

One of ordinary skill in the art will recognize that additional brackets may be used to support additional shelves. Alternatively, accessories 124 other than (or in addition to) brackets may be supported from the front portion 142 of the display support system 120.

For example, as shown in FIG. 1, a wire hanger may be used to support a number of product packages in a back-to-front orientation from a wire hanger. Such wire hangers can be formed to engage the front portion 142 of the display support system 120 using tabs such as the tabs 164 used by the brackets 126.

As another example, clips are often used to grip an upper edge of a packaged product. The clips may be used singly but are often arranged in a vertical row. Such clips may be secured, either singly or in a pre-structured vertical row, to the front portion 142 of the display support system 120. Tabs such as the tabs 164 of the brackets 126 may be used to support the clips or gangs of clips.

The front portion of a display support system of the present invention can take many forms and need not take the form of the example front portion 142 described above. For example, in a simple configuration, the front portion 142 may comprise a single horizontal or vertical member adapted to engage one or more types of desired accessories 124. Alternatively, instead of discrete vertical and horizontal members, the front portion may comprise a sheet of material such as cardboard or plywood adapted to engage one or more types of desired accessories 124. Or instead of a rectangular arrangement of straight vertical and horizontal members, the front portion may be made of curved or angled members in a more fanciful shape.

The rear portion of a display support system of the present invention may also take on a number of different forms depending upon the particular application. As perhaps best shown in FIGS. 6 and 7, the example rear portion 140 comprises a mounting portion 170 comprising first and second spacing members 172 and 174. The example spacing members 172 and 174 are metal sheets in which first and second through holes 176 and 178 are formed.

The mounting portion 170 further comprises a mounting member 180 that extends between the spacing members 172 and 174. The example mounting member 180 is a metal sheet, and the first and second spacing members 172 and 174 are welded to opposite ends of the mounting member 180.

The mounting portion 170 may be made of other materials in other configurations. For example, the mounting portion 170 can be made of plastic or wood and take on other shapes. In addition, instead of discrete spacing and mounting members 172, 174 and 180, the mounting portion 170 can be formed of a single molded or milled member.

In the example display support system 120, the magnetic portion 144 comprises first and second magnetic members 182 and 184 that are secured to a bottom surface 186 of the mounting member 180. The example magnetic members 182 and 184 are in the form flat magnetic sheets having a width dimension that is approximately the same as a width dimension of the mounting member 180. The length of the example magnetic members 182 and 184 is approximately one-third the length of the mounting member 180. In the example rear portion 140, the magnetic members 182 and 184 are glued to opposite ends of the mounting member 180 such that a middle one-third of the bottom surface 186 thereof is not covered by a magnetic member.

The nature, quantity, and configuration of the magnetic members 182 and 184 can take on a number of forms depending upon the precise nature of the rear portion 140 of the display support system 120 and the accessories 124 to be suspended therefrom.

In addition, the magnetic members 182 and 184 can be secured to the mounting member 180 by means other than adhesives. For example a shallow channel or socket may be formed in the mounting member for the magnetic member or members. The magnetic members may also be embedded or laminated in the mounting member.

With the example support system 120 described above, the mounting member 180 of the rear portion 140 indirectly engages the top surface 130 through the magnetic members 182 and 184. In other configurations, the rear portion 140 may directly engage the top surface 130.

Referring again to FIGS. 2 and 3, illustrated therein are first and second bolts 190 and 192. As perhaps best shown in FIG. 4, the bolts 190 and 192 are received in first and second threaded openings 194 and 196 to secure the rear portion 140 to the front portion 142.

The rear portion 140 may be rigidly attached to the front portion 142 using means other than threaded bolts. For example, as in the first embodiment 20 described above, the rear and front portions 140 and 142 may be integrally formed with each other. As another example, the rear and front portions 140 and 145 may be separately formed and the rigidly connected by adhesives, welding, or the like.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. A support system for supporting a product for retail display from a metal structure comprising a substantially horizontal top surface and a substantially vertical side surface, the support system comprising:

an accessory adapted to support the product for retail display;

a rear portion, where the rear portion is sized and dimensioned to extend over a portion of the top surface of the metal structure;

a front portion rigidly connected to the rear portion, where the front portion is sized and dimensioned to extend along a portion of the side surface;

a magnetic portion rigidly connected to the rear portion; whereby the front and rear portions are rigidly connected such that, when the rear portion extends along the top surface, the front portion extends along the side surface;

the front portion is adapted to support the accessory;

when the rear portion extends partly over the top surface, the rear portion is supported by the top surface of the metal structure such that downward loads on the front portion are transferred to the metal structure through the rear portion; and when the rear portion extends partly over the top surface, the magnetic portion is adapted to be magnetically attracted to the top surface of the metal structure to inhibit movement of the front portion away from the side surface.

2. A support system as recited in claim 1, in which the front portion extends at substantially a right angle to the rear portion.

3. A support system as recited in claim 1, in which the front portion is adapted to support at least one accessory on which the product is arranged.

4. A support system as recited in claim 3, in which the accessory is a wire support.

5. A support system as recited in claim 1, in which the accessory comprises a shelf bracket.

6. A support system as recited in claim 1, in which the front portion defines a plurality of slots for receiving tabs extending from the accessory.

7. A combination of:

a primary product display unit defining a substantially horizontal top surface, a substantially horizontal side display surface, and a substantially horizontal front door surface, where at least the top surface of the primary product display unit is metal; and a secondary product display unit comprising an accessory adapted to support the product for retail display;

a rear portion, where the rear portion is sized and dimensioned to extend over a portion of the top surface of the metal structure;

a front portion rigidly connected to the rear portion, where the front portion is sized and dimensioned to extend along a portion of the display surface;

a magnetic portion rigidly connected to the rear portion; whereby the front and rear portions are rigidly connected such that, when the rear portion extends along the top surface, the front portion extends along the side display surface;

when the rear portion extends partly over the top surface, the rear portion is adapted to be supported by the top surface of the primary product display unit to transfer to the primary product display unit downward loads on the front portion, and the magnetic portion is magnetically attracted to the top surface of the primary product display unit to inhibit movement of the front portion away from the side display surface; and the front portion is adapted to support the accessory.

8. A combination as recited in claim 7, in which the front portion extends at substantially a right angle to the rear portion.

9. A combination as recited in claim 7, in which the front portion is adapted to support at least one accessory on which the product is arranged.

10. A combination as recited in claim 7, in which the accessory is a wire support.

11. A combination as recited in claim 7, in which the accessory comprises a shelf bracket.

12. A support system as recited in claim 7, in which the front portion defines a plurality of slots for receiving tabs extending from the accessory.

13. A method of displaying a product comprising the steps of:

providing a primary product display unit defining a substantially horizontal top surface, a substantially horizontal side display surface, and a substantially horizontal front door surface, where at least the top surface of the primary product display unit is metal; and providing a secondary product display unit comprising an accessory adapted to support the product for retail display, a rear portion, a front portion, and a magnetic portion;

rigidly connecting the front portion to the rear portion;

rigidly connecting the magnetic portion to the rear portion;

extending the rear portion over a portion of the top surface of the metal structure such that downward loads on the front portion are transferred to the top surface of the primary product display unit, the front portion extends along a portion of the side display surface, and the magnetic portion is magnetically attracted to the top surface of the primary product display unit to inhibit movement of the front portion away from the side display surface; and supporting the accessory on the front portion.

14. A method as recited in claim 13, in which the step of rigidly connecting the front portion to the rear portion comprises the step of extending the front portion at substantially a right angle to the rear portion.

15. A method as recited in claim 13, further comprising the step of adapting the front portion to support at least one accessory on which the product is arranged.

16. A method as recited in claim 13, in which the accessory is a wire support.

17. A method as recited in claim 13, in which the accessory comprises a shelf bracket.

18. A method as recited in claim 13, in which:

the step of providing the secondary product display unit comprises the steps of forming a plurality of slots in the front portion; and forming tabs extending from the accessory; and the step of supporting the accessory on the front portion comprises the step of inserting the tabs on the accessory into at least some of the slots in the front portion.

* * * * *